US011525168B2

(12) United States Patent
Campana, Sr.

(10) Patent No.: US 11,525,168 B2
(45) **Date of Patent: *Dec. 13, 2022**

(54) CORED WIRE WITH PARTICULATE MATERIAL

(71) Applicant: P.C. Campana, Inc., Lorain, OH (US)

(72) Inventor: David L. Campana, Sr., Lorain, OH (US)

(73) Assignee: P.C. CAMPANA, INC., Lorain, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/142,676

(22) Filed: Jan. 6, 2021

(65) Prior Publication Data

US 2021/0123112 A1 Apr. 29, 2021

Related U.S. Application Data

(63) Continuation of application No. 16/180,252, filed on Nov. 5, 2018, now Pat. No. 10,927,425.

(60) Provisional application No. 62/585,572, filed on Nov. 14, 2017.

(51) Int. Cl.

| | |
|---|---|
| ***C21C 7/00*** | (2006.01) |
| ***B21C 1/02*** | (2006.01) |
| ***B21C 37/04*** | (2006.01) |
| ***C21C 7/04*** | (2006.01) |
| ***B21C 37/10*** | (2006.01) |
| ***B21C 37/08*** | (2006.01) |

(52) U.S. Cl.

CPC ..... *C21C 7/0056* (2013.01); *B21C 1/02* (2013.01); *B21C 37/045* (2013.01); *C21C 7/0006* (2013.01); *C21C 7/04* (2013.01); *B21C 37/08* (2013.01); *B21C 37/10* (2013.01)

(58) Field of Classification Search

None

See application file for complete search history.

(56) References Cited

U.S. PATENT DOCUMENTS

| | | | |
|---|---|---|---|
| 4,035,892 | A | 7/1977 | Ototani et al. |
| 4,094,666 | A | 6/1978 | Ototani |
| 4,097,268 | A | 6/1978 | Ototani et al. |
| 4,481,032 | A | 11/1984 | Kaiser |
| 4,512,800 | A | 4/1985 | Wirth, Jr. |
| 4,671,820 | A | 6/1987 | Ototani et al. |
| 4,698,095 | A | 10/1987 | Ototani et al. |
| 4,705,261 | A | 11/1987 | Wirth, Jr. |
| 5,376,160 | A | 12/1994 | Neuer et al. |
| 6,280,497 | B1 | 8/2001 | King et al. |
| 7,906,747 | B2 | 3/2011 | Poulalion |
| 10,927,425 | B2 * | 2/2021 | Campana, Sr. ..... C21C 7/0006 |
| 2009/0311553 | A1 | 12/2009 | Colavito |

(Continued)

*Primary Examiner* — Scott R Kastler

(74) *Attorney, Agent, or Firm* — Rankin, Hill & Clark LLP

(57) ABSTRACT

A cored wire for refining molten metal includes a reactive core material that is in the form of a solid rod. A non-reactive particulate material radially surrounds the solid core material, and an exterior metal jacket radially surrounds the particulate material. The particulate material may include wood or other material that when introduced into the molten metal, undergoes thermal decomposition to release carbon dioxide, hydrocarbons, or combinations thereof as a shroud around the core material.

20 Claims, 4 Drawing Sheets

(56) References Cited

U.S. PATENT DOCUMENTS

| | | | | |
|---|---|---|---|---|
| 2013/0167688 | A1* | 7/2013 | Dressel | C21C 7/068<br>75/500 |
| 2015/0267272 | A1* | 9/2015 | Markwitz | C21C 7/0056<br>75/304 |
| 2019/0144960 | A1 | 5/2019 | Campana, Sr. | |

* cited by examiner

CORED WIRE WITH PARTICULATE MATERIAL

CROSS-REFERENCE TO RELATED APPLICATION

The present application is a continuation of U.S. application Ser. No. 16/180,252 filed Nov. 5, 2018, which itself claims priority to U.S. Provisional Patent Application Ser. No. 62/585,572, filed Nov. 14, 2017, both of which is incorporated herein by reference.

BACKGROUND

Cored wire has found wide application in the treating of molten ferrous metals. In one application, cored wire is used to introduce a core material (e.g., calcium) into the molten ferrous metal after the molten ferrous metal has been tapped from a furnace, in order to reduce unwanted elements (e.g., sulfur and oxygen) in the bath of molten ferrous metal. A detailed discussion of this overall process is provided in U.S. Pat. No. 4,481,032, which is expressly incorporated herein by reference. Further methods of treating molten metals using a clad reactive cored metal composite in the form of an elongated wire are disclosed in U.S. Pat. Nos. 4,512,800; 4,705,261; 4,094,666; 4,698,095; 4,035,892; 4,097,268; and 4,671,820, all expressly incorporated in their respective entirety herein.

Cored wire has found commercial use in the steel, aluminum, copper and foundry industries. In general, cored wire is a continuous metal tube filled with a solid or granule element or alloy used as a core material to control the chemistry of the molten metal to which it is added. The manufacture of cored wire generally involves the use of roll forming equipment, which takes a flat steel strip, bends it in a general U-shape, adds a core material (e.g., calcium), and then folds and crimps the radial edges of the steel strip over on themselves (or welds the radial edges together) and coils the product into a spool for later use in connection with treating molten metals.

The encapsulated core material, calcium metal, has higher recovered yield when the final encapsulated core material is in a solid rod form rather than particulate/granular form. U.S. Pat. No. 6,280,497 to Mineral Technologies, which is expressly incorporated herein by reference, shows a two-step process for producing a calcium rod product where the rod is first produced by extrusion and afterward, in a separate manufacturing operation, encased in a steel jacket. Benefits directly attributable to calcium treatment of steel include greater fluidity, simplified continuous casting and improved cleanliness (including reduced nozzle blockage), machinability, ductility and impact strength in the final product.

However, calcium metal and other core materials may display a high affinity to oxygen, a low melting and/or vapor point, a high vapor pressure, a low solubility in the molten metal, low density compared to the molten metal, or a combination of these factors. As such, the calcium may sublime when the core material is exposed to the molten metal and then quickly react with dissolved oxygen in the steel. This sublimation of the calcium from solid directly to gas may cause splashing at the surface of the melt creating problems during refining, and may result in a lower recovered yield (i.e. the amount of core material remaining in the molten metal divided by the amount of core material injected into the molten metal). Calcium has such a high vapor pressure (its boiling point is several hundred degrees below steelmaking temperatures) and reactivity that special techniques have been devised to introduce and properly retain even a few parts per million in the melt.

Because calcium exists as a gas in molten steel, and because it is scarcely soluble in steel, any reaction between calcium and the oxygen and sulfur in the melt can only take place at the calcium vapor/liquid steel interface. However, this interface forms only temporarily as the calcium vapor quickly rises to the top of the melt. Therefore, lance and cored wire injection techniques have been developed to introduce the calcium as close the bottom of the melt as possible, to thereby increase the amount of time the calcium gas is in contact with the liquid steel.

BRIEF DESCRIPTION

According to one aspect, an elongated cored wire for treating molten steel includes a solid elongated rod including calcium metal, a particulate material, and an exterior metal jacket. A length of the rod extends along a length of the cored wire. The particulate material is continuously arranged along the length of the cored wire. The exterior metal jacket radially surrounding the rod and the particulate material along the length of the cored wire. When the cored wire is introduced into the molten steel, the particulate material undergoes thermal decomposition to release carbon dioxide, hydrocarbons, or combinations thereof.

According to another aspect, a method of making a cored wire for treating molten steel includes providing a metal strip defining a trench extending along a length of the metal strip. A providing a solid rod including calcium metal is arranged in the trench such that a length of the rod extends along the length of the metal strip. A particulate material is introduced into the trench such that the particulate material is continuous along the length of the metal strip. The rod and the particulate material are radially surrounded with the metal strip along the length of the metal strip. When the cored wire is introduced into the molten steel, the particulate material undergoes thermal decomposition to release carbon dioxide, hydrocarbons, or combinations thereof.

According to yet another aspect, a method of treating molten steel includes providing a cored wire including a solid rod including calcium metal and extending along a length of the cored wire, a particulate material arranged along the length of the cored wire, and an exterior metal jacket radially surrounding the rod and the particulate material along the length of the cored wire. The cored wire is introduced into the molten steel such that the particulate material undergoes thermal decomposition to release carbon dioxide, hydrocarbons, or combinations thereof as a shroud around a leading end of the rod to thereby allow the calcium at the leading end of the rod to melt.

DETAILED DESCRIPTION

Figure 1:
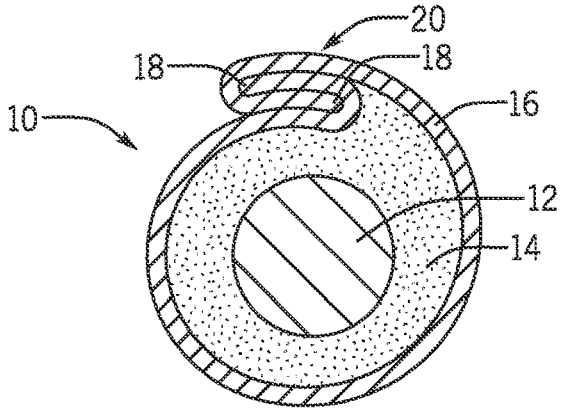
FIG. 1 is a cross-sectional view of a cored wire according to an exemplary embodiment.
Figure 2A:
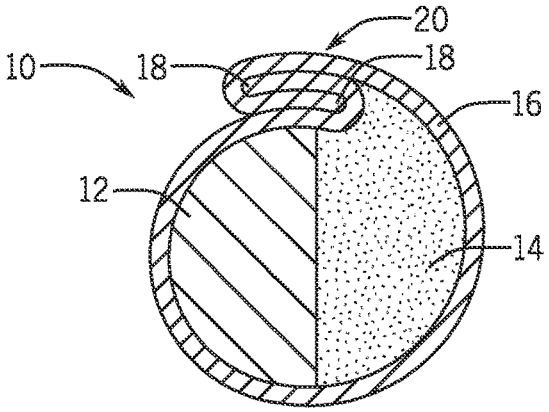
FIGS. 2A and 2B are cross-sectional views of another cored wire according to an exemplary embodiment.
Figure 2B:
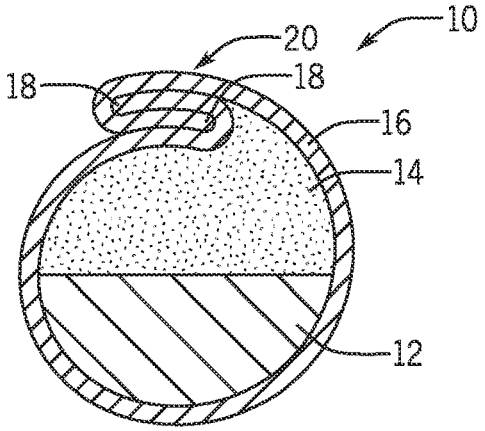
Figure 3:
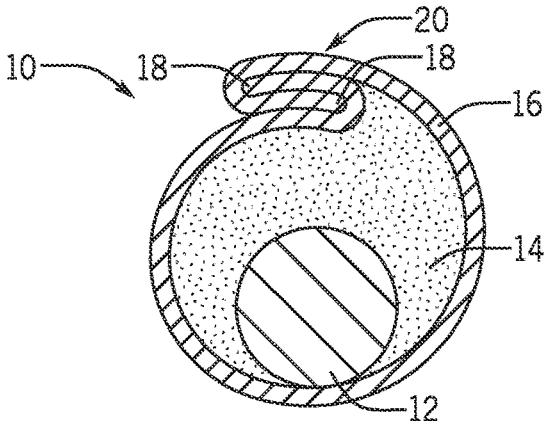
FIG. 3 is a cross-sectional view of still another cored wire according to an exemplary embodiment.

Referring now to the drawings, which are for illustrating exemplary embodiments and not for purposes of limiting the same, FIGS. 1-3 show a cross-section of an elongated cored wire 10 including or consisting of a core material 12, a particulate material 14, and an exterior metal jacket 16 surrounding the core material 12 and the particulate material 14.

A length of the cored wire 10 extends perpendicular to the plane of the cross-section shown in FIGS. 1-3, and is not particularly limited by the present subject matter. The cored wire 10 may be coiled in a spool and used for treating (e.g. refining) molten metal. The cored wire 10 may be continuous along its length, as may be the exterior metal jacket 16 and the core material 12.

The jacket 16 defines the exterior surface of the cored wire 10, and is included to temporarily isolate the core material 12 from the molten metal. After the cored wire 10 is inserted into the molten metal, the jacket 16 will eventually melt or otherwise be consumed by the molten metal, to thereby expose the particulate material 14 and core material 12 to the molten metal. This temporary isolation of the core material 12 provided by the jacket 16, allows the core material 12 to be inserted deeper into the mass of the molten metal before being exposed to the molten metal.

The jacket 16 also isolates the core material 12 and particulate material 14 from the environment during transport and storage of the cored wire 10. The jacket 16 also acts as a package to contain the core material 12 and particulate material 14 and to keep the core material 12 and particulate material 14 together and in contact with one another. In this regard, the length of the cored wire 10 is defined by the length of the jacket 16.

The jacket 16 can be formed from a continuous sheet metal stock such as a continuous metal sheet or strip. The jacket may be made of any suitable metal(s) or alloy(s). In one embodiment, the jacket 16 is a steel jacket, such as formed from a low carbon 1006/1008 grade of steel, for example. The jacket 16 may have an outside diameter of about 5 mm to about 25 mm, and a thickness of the wall of the jacket 16 may range from 0.1-2 mm. In an exemplary embodiment, the jacket 16, and thus the cored wire 10, has an outside diameter of 5-15 mm, preferably 9-13 mm.

The exterior metal jacket 16 may be continuous along the length of the cored wire 10, and may be formed from a continuous strip of metal sheeting. The edges 18 of the jacket 16 may be joined together by a lock seam 20, which is made by overlapping and folding the edges 18 together as shown, a double lock seam, or may be welded together by a lap joint or a butt joint, or other type of welded joint. Since the edges 18 of the jacket 16 are joined together, the jacket 16 thus surrounds the core material 12 and the particulate material 14 in a radial direction. If desired, two longitudinal ends (in the length direction) of the cored wire 10 may be sealed such as by crimping, folding, welding, brazing, or otherwise. To encapsulate the core material 12 and the particulate material 14.

The core material 12 is included for refining (i.e. treating) the molten metal. The core material 12 may include any suitable material for treating the molten metal, including but not limited to pure metals of calcium, aluminum, nickel, or combinations thereof; and alloys of calcium-silicon alloy (CaSi), a ferro-titanium alloy (FeTi), a ferro-boron alloy (FeB), calcium-aluminum, magnesium-calcium, magnesium-aluminum, calcium-silicon, etc., or any combination thereof. These metals and alloys of the core material 12 may be substantially free of impurities, which means that the core material 12 contains less than 1% w/w impurities, such as less than 0.9, 0.8, 0.7, 0.6, 0.5, 0.4, 0.3, 0.2% w/w impurities, e.g. less than 0.1% w/w impurities. The core material 12 can be any material having a melt point below a temperature required to mechanically lock radial ends of the sheet metal stock after further roll forming (e.g., by welding, soldering, etc.).

The core material 12 may be a continuous and elongated solid structure, as opposed to being in particulate form. In an exemplary embodiment, the core material 12 is a solid core material 12 in the form of an elongated solid wire/rod. Along the length of the cored wire 10, the solid rod of core material 12 may be continuous (i.e. a single piece of core material 12 extending the length of the cored wire 10) or discontinuous (more than one piece of core material 12 abutted against each other and collectively extending the length of the cored wire 10). In an exemplary embodiment, the core material 12 is a single elongated piece of core material 12 that is continuous along the length of the cored wire 10. The rod of core material 12 may be formed by extrusion, drawing, casting, roll forming, or other processes to make a solid rod of core material 12. In an exemplary embodiment, the core material 12 may be an extruded rod, e.g. an extruded rod of calcium metal.

In an exemplary embodiment, the core material 12 includes or consists of calcium. Alternatively, the reactive component can be sulfur, magnesium, tin, antimony, lead, sodium, or any other material as desired for a particular application. When included in the core material 12, the calcium may be substantially free of impurities. The calcium is in the form of a solid rod that is solid and may be continuous along the length of the cored wire 10. Being in the form of a solid rod, only the outer surface of the calcium rod may be exposed the atmosphere and thus possibly subjecting the outer surface to oxidation. However, the inner mass of the calcium rod is not exposed to the atmosphere and thus may not oxidize. This characteristic can be beneficial as compared to calcium in particulate form being used as the core material 12, since calcium in particulate form has a greater surface area per mass than a solid rod. This provides an increased surface area per mass that can be exposed to the atmosphere, and possibly subjected to oxidation.

In an embodiment, the core material 12 (e.g., calcium) is present in the cored wire 10 at about 0.02 pounds per linear foot of the cored wire 10, up to about 0.10 pounds per linear foot of the cored wire 10. In a more specific embodiment, the reactive component is about 0.045 pounds per linear foot of the cored wire 10.

The particulate material 14 is included in the cored wire 10 for further isolating the core material 12 from the molten metal over and above the isolation provided by the jacket 16, and may be generally non-reactive or have a low reactivity with the molten metal such that the chemistry of the molten metal is not significantly changed by the particulate material 14.

While not being bound by theory, it is believed that the particulate material 14 isolates the core material 12 from the molten metal in a number of ways. First, the particulate material 14 may be arranged in the cored wire 10 so as to radially surround the core material 12 as depicted in FIG. 1. This arrangement provides a barrier layer of particulate material 14 radially interposed between, and thus separating, the core material 12 and the molten metal. Second, the particulate material 14 may provide a certain degree of thermal isolation for the core material 12 from the heat of the molten metal, thereby allowing the core material 12 to remain as a solid for a longer period of time after insertion into the molten metal, and thus deeper insertion into the molten metal. This thermal insulation may also allow the solid core material 12 to melt into a liquid and react with the molten metal, instead of sublimating directly into a gas. Third, upon melting of the jacket 15, the particulate material 14 is exposed to the molten metal, and may thereby thermally decompose (e.g. pyrolyze) to give off gas, e.g. carbon dioxide, hydrocarbons, or combinations thereof as a majority (over 50 wt %) of the reaction products. This gas can form a gas shroud within the molten metal and around the leading end of the cored wire 10. This gas shroud can offer further thermal insulation to the core material 12 to allow it to melt into a liquid and react with the molten metal.

The particulate material 14 is included inside the jacket 16 in a continuous manner along the entire length of the cored wire 10. In other words, the particulate material 14 is included in the cored wire 10 so that there is a continuous line of particulate material 14 along the entire length of the cored wire 10. In this configuration, if the cored wire 10 were cut at any point along its length, the portion of the cored wire that is cut would necessarily include particulate material 14. This embodiment including a continuous line of particulate material 14 may be contrasted to a comparative cored wire having islands of particulate material 14 along its length, which islands would have gaps between them separating one from another. In this contrasting configuration, if the cored wire were cut at a point along its length, the cut portion may or may not include particulate material 14.

The particulate material 14 is also included in a substantially uniform amount along the length of the cored wire 10. That is, the amount of particulate material at any point along the length of the cored wire 10 is at or above a minimum predetermined threshold. In this configuration, if the cored wire 10 were cut at any point along its length, the portion of the cored wire that is cut would necessarily include at least a minimum amount of the particulate material 14 that is at or above the predetermined threshold.

The particulate material 14 may be radially interposed between core material 12 and the jacket 16 (FIG. 1), arranged next to the core material 12 (FIGS. 2A and 2B), or only partially radially surrounding the core material 12 (FIG. 3), so long as the particulate material 14 is continuous along the length of the cored wire 10.

In FIG. 1, the core material 12 is in a solid rod form with a circular cross-section, while the particulate material 14 is arranged radially around the rod to radially surround the core material 12, such that the core material 12 does not contact the jacket 16. In FIG. 2A, the core material 12 is in a solid rod form with a half-circular cross-section, while the particulate material 14 is arranged side-by-side with the core material 12. In FIG. 2B, the core material 12 is in a solid rod form with a half-circular cross-section, while the particulate material 14 is arranged on top of the core material 12. In FIG. 3, the core material 12 is in a solid rod form with a circular cross-section, while the particulate material 14 is arranged only partially radially surrounding the core material 12, such that the core material 12 contacts the jacket 16. In FIGS. 1-3, the seam between the two edges 18 of the jacket 16 are depicted as lock seams 20. However, this configuration is not required, and instead the two edges 18 could be joined by other means including welding.

In one embodiment, the particulate material 14 is about 1 to about 30 percent of the total linear weight of the cored wire 10. In a specific embodiment, the particulate material 14 comprises wood, e.g. wood particles or wood sawdust. The particulate material flows and thus fills up empty space within the jacket 16 not occupied by the core material 12. For example, the particulate material 14 may include one or more species of wood such as Maple, Oak, and other non-resinous or low-resinous species. The wood may exclude high-resinous species such as cedar, fir, juniper, pine, redwood, spruce, yew, larch.

The particulate material 14 may have a mesh size of about 10-100, or an average particle size of 0.149 mm to 2 mm. In one embodiment, the particulate material 14 is not soaked or loaded with any liquid. The particulate material 14 may be dried or otherwise may have a moisture content of less than 10 wt %, less than 8 wt %, or less than 5 wt %.

When the particulate material 14 is of a size and moisture content as described herein, individual particles of the particulate material 14 may freely flow past one another, for example when arranged on an inclined surface and subject to gravity. This feature may be useful in preparing the cored wire 10 as described in more detail herein. When the particulate material 14 has a size or moisture content outside those specified herein, the particulate material 14 may not readily flow, and instead individual particles may agglomerate or stick to various surfaces of production equipment.

The particulate material 14 may include other non-reactive components used with, or in substitution for the wood. These include, but are not limited to, dry polyurethanes, Bauxite, cellulose fibers, bentonite clays, lime products (e.g., calcium oxide), hemp, cotton, burlap, jute (natural or synthetic), flax, rayon, felt or silk, or other materials, such as cellulosic materials, that may undergo thermal decomposition in the molten metal and release carbon dioxide, hydrocarbons, or combinations thereof as a gas shroud around the core material 12.

Advantageously, it is believed that the particulate material 14 forms a shrouding gas when the cored wire 10 is added to molten steel, which has the beneficial effect of creating a protective shielding volume for the reactive core material 12 (e.g., calcium). In other embodiments, the particulate material 14 may be replaced or supplemented by the use of the above-referenced non-reactive components in the form of string, twine, ribbon, cloth or strips arranged radially around or next to the core material 12.

Because of the isolation from the molten metal that is provided by the particulate material 14 (and the jacket 16), the reactive core material 12 tends to melt more slowly than if the particulate material 14 were not included. This allows the core material 12 to be inserted deeper into the molten metal than would otherwise be feasible, thereby releasing the refining core material 12 under high static pressure, separate from oxygen present in the slag and atmosphere above, and increasing the floatation time of low density core material 12, these all being favorable factors for achieving a high recovery.

The cored wire 10 may be formed in a continuous or semi-continuous manner by contouring (e.g. bending) a strip 24 of sheet metal stock 22 into a desired shape to thereby define the jacket 16 and to radially surround the core material 12 and the particulate material 14.

The sheet metal stock 22 may be in the form of a continuous metal strip 24 that is initially flat (e.g. flat cross section), which can be fed from a first roll 26 and processed, such as by roll forming, to contour the metal strip 24 so as to eventually form a tubular shape about the core material 12 and the particulate material 14 to fully surround both the core material 12 and the particulate material 14.

The flat metal strip 24 may be processed by being fed through a first series of rollers 28 and a second series of rollers 38 that roll form the flat strip 24 into a desired shape. During roll forming, strip 24 may be formed to have a trench 32, in which the core material 12 and the particulate material 14 are arranged. The trench 32 may extend along a length of the strip 24. Edges 18 of the strip 24 are then mechanically locked together to form the lock seam 20, which seals the core material 12 and the particulate material 14 within the jacket 16. Alternatively, the lock seam 20 of the jacket 16 could be replaced with welded seams, for example using HF (high frequency) or laser welding.

The first roll 26 provides a continuous flat strip 24 of sheet metal stock 22, which can be delivered to an entrance 30 of the first series of rollers 28 starting with a first set of rollers 48. The first series of rollers 28 contour the flat strip 24 such that the flat metal strip 24 is formed to have the trench 32. This forming may include bending the strip 24 so that the two edges 18 of the strip 24 are moved upward and closer together as compared to when the strip 24 was flat.

Figure 7:
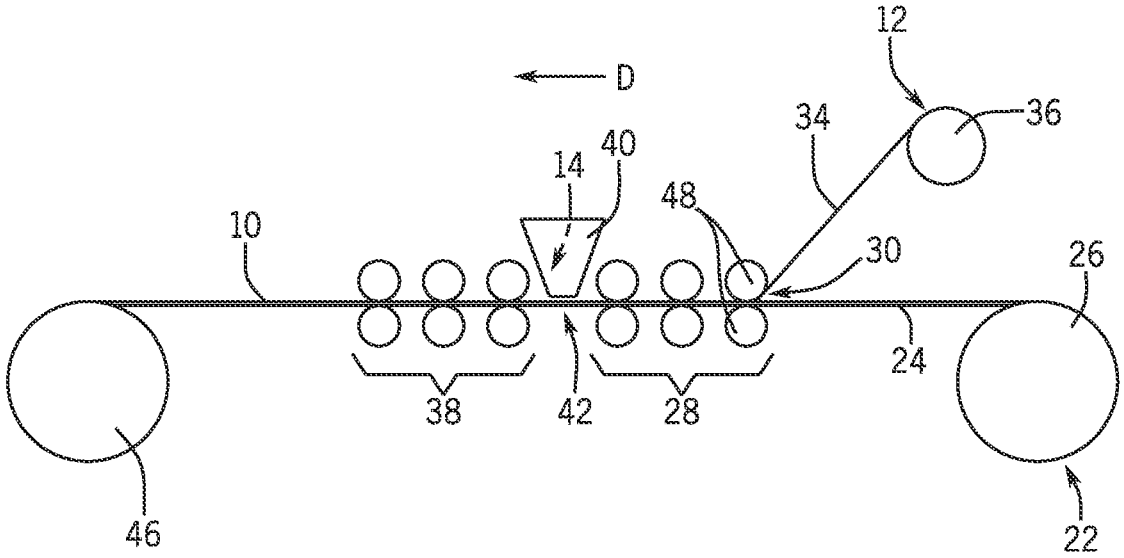
FIG. 7 is a side schematic view of a method of making cored wire according to an exemplary embodiment.

As the strip 24 is being fed through the first series of rollers 28, a solid rod 34 of core material 12 is fed from a second roll 36 and arranged on the strip 24. The solid rod 34 may be introduced at the entrance 30 of the first series of rollers 28 as depicted in FIG. 7 at which point the strip 24 may be flat; or the solid rod 34 may be introduced at a later point after the first set of rollers 48 and before the end of the first series of rollers 28, at which point the strip 24 may include the trench 32, or be contoured by the first set of rollers 48 and possibly others in the first series of rollers 28 to a degree between being flat and having the trench 32. After the core material 12 is arranged on the strip 24, the remaining rollers in the first series of rollers 28 may then continue to contour the strip 24 to include the trench 32.

Figure 4:
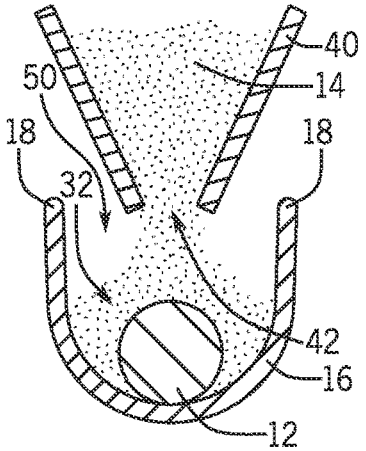
FIG. 4 is a cross-sectional view of a method of making a cored wire according to an exemplary embodiment.
Figure 5:
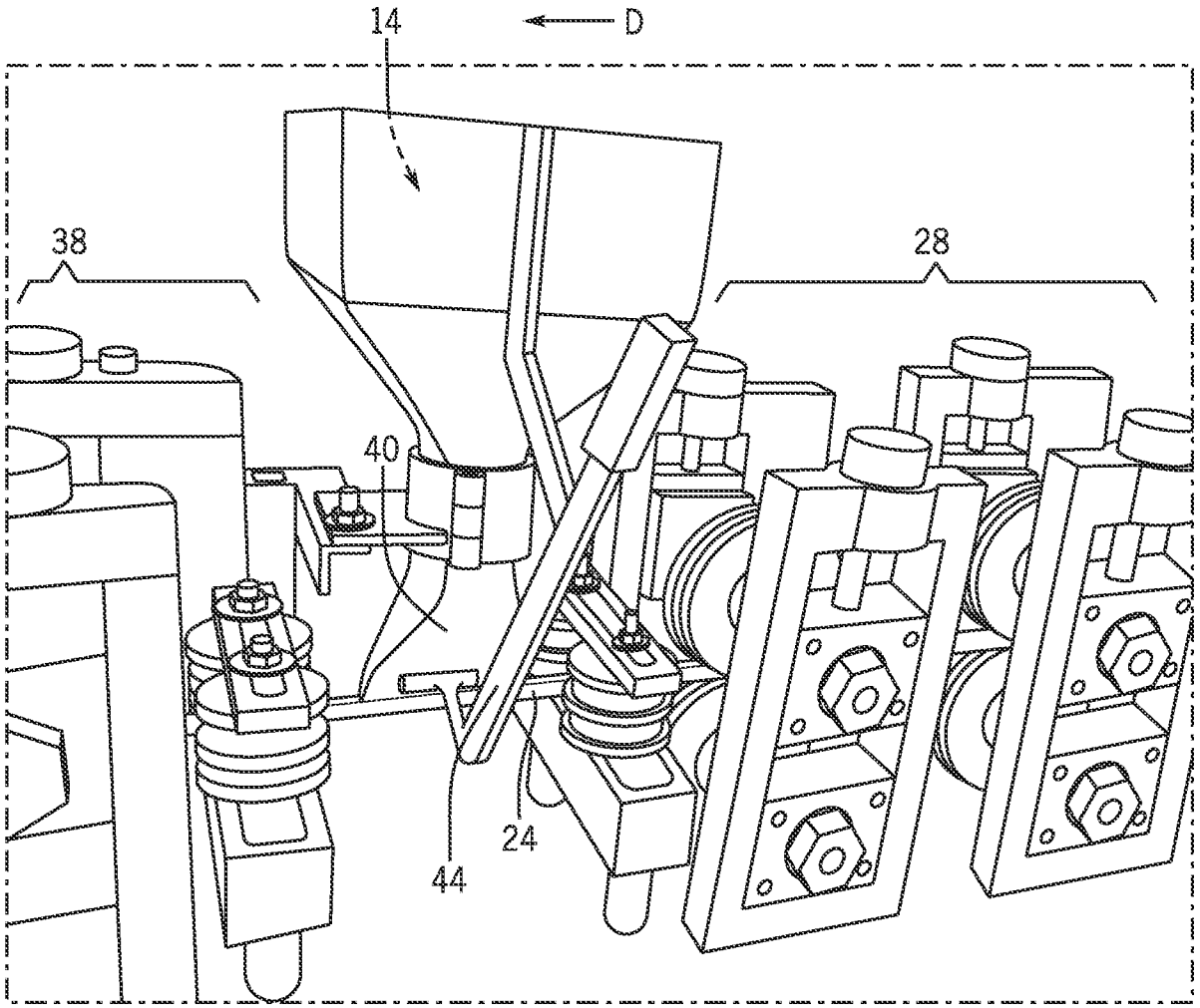
FIG. 5 is a perspective view of a method of making a cored wire according to an exemplary embodiment.
Figure 6:
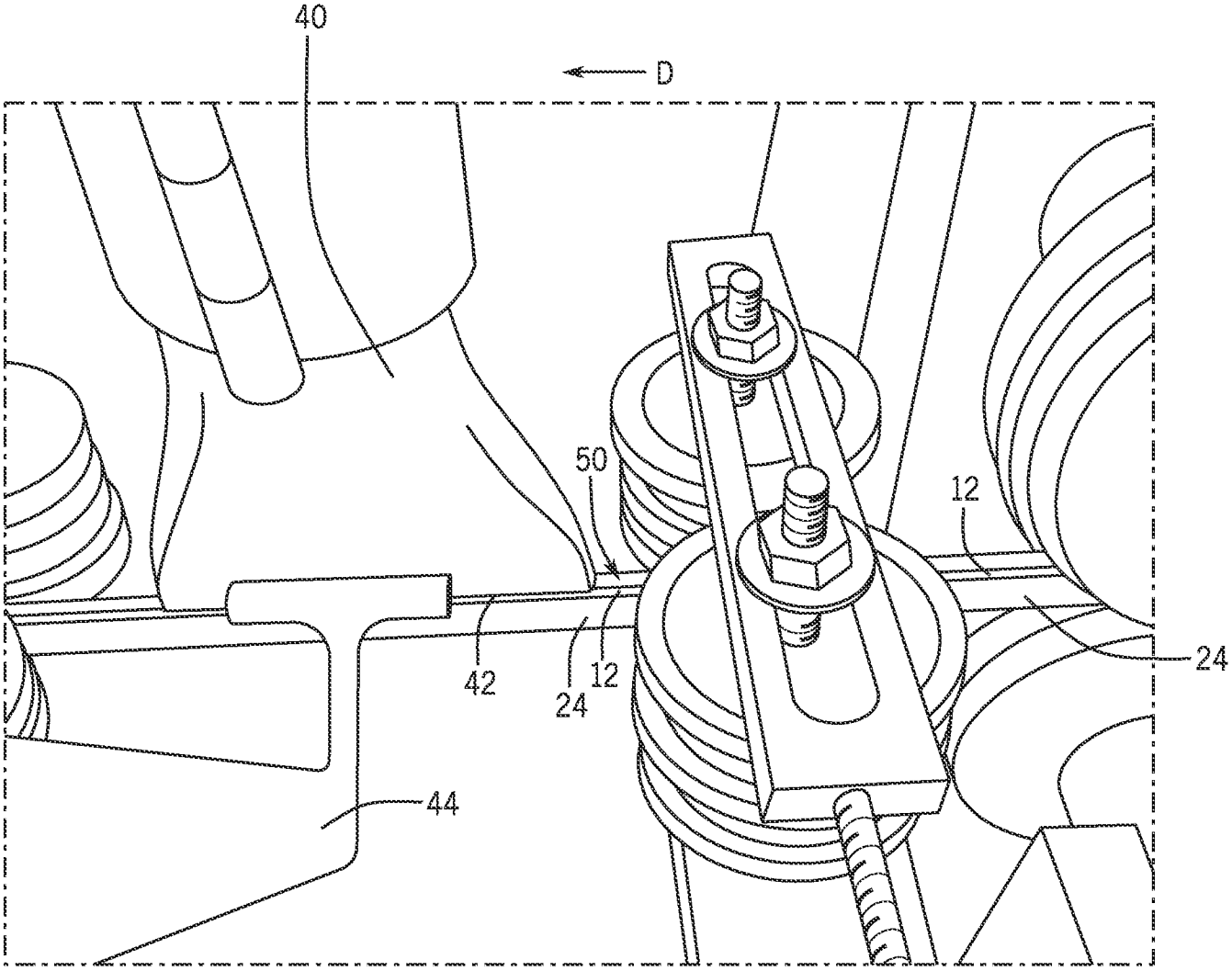
FIG. 6 is a detailed perspective view of the method of FIG. 5.

After the trench 32 is formed in the strip 24, the strip 24 may have a general U-shaped (FIG. 4), general V-shaped, or other general cross-sectional shape defining an opening 50 at the top. The solid rod 34 of core material 12 is arranged in the trench 32, and the particulate material 14 is delivered to the trench 32 through the opening 50 as depicted for example in FIG. 4. The particulate material 14 may be delivered using a funnel/hopper 40, which may include an elongated opening 42 having a length parallel to the direction D of feeding the strip 24 and rod 34. The funnel 40 may be arranged between the first series of rollers 28 and the second series of rollers 38. The funnel 42 may include a vibrator 44 or other mechanism that taps the funnel 40 near the opening 42 or otherwise imparts vibrations to the funnel 40 so as to facilitate the flow of dry particulate material 14 through the opening 42 and into the trench 32. For this purpose, the vibrator 44 may be biased with a spring to impart vibrations to the funnel 40; or may be connected to, or be comprised of, a motor to impart vibrations to the funnel 40. A frequency at which the vibrator 44 vibrates may be adjusted as desired for a particular delivery rate of the particulate material 14.

After the particulate material 14 is arranged in the trench 32, the trench 32 may be closed by bringing the two edges 18 of the strip 24 together and sealing them, e.g. with a lock seam 20, to thereby form the cored wire 10. Sealing of the two edges 18 may be performed by the second series of rollers 38, after which the cored wire 10 may be coiled in a spool 46 for storage, delivery, and/or use.

Although the particulate material 14 may be dropped from the funnel 40 to be on top of the rod 34 of core material 12, this configuration may or may not remain constant through the remainder of the process. If the configuration of the particulate material 14 being on top of the core material 12 does remain constant through the remainder of the process, a cored wire 10 may be produced as depicted in FIG. 3, for example. However, movement through the second series of rollers 38 may cause, e.g. through vibrations, the particulate material 14 to move within the trench 32 so as to radially surround the core material 12 and thereby produce a cored wire 10 as shown in FIG. 1. Other configurations of the core material 12 and the particulate material 14 are possible, including those shown in FIGS. 2A and 2B. In another embodiment, the particulate material 14 may be introduced into the trench 32 before or contemporaneous with the core material 12.

The production of the cored wire 10 may be initiated by feeding a leading edge of the strip 24 and a leading end of the solid rod 34 into the first series of rollers 28. The production of the cored wire 10 may be continuous until one or both of the first roll 26 and the second roll 36 are used up, at which point another roll of sheet metal stock 22 or another roll of core material 12 may be utilized. A leading end and a trailing end of the cored wire 10 may be sealed.

The cored wire 10 may be used for refining molten metal, e.g. steel. The steel may be refined by introducing the cored wire into the molten metal by first inserting a leading end of the cored wire 10 into the molten metal and then continuously feeding a length of the cored wire 10 into the molten metal. As the cored wire is introduced into the molten steel, the jacket 16 at the leading end of the cored wire 10 melts and the particulate material at the leading end of the cored wire 10 undergoes thermal decomposition to release carbon dioxide, hydrocarbons, or combinations thereof as a shroud around the core material 12 at the leading end. This shroud allows the core material 12 (e.g. calcium) at the leading end to melt and react with the molten metal.

The refining process may be discontinued when a predetermined amount of the core material 12 is inserted into the molten metal.

Depending on the composition of the core material 12, the molten metal being treated may include ferrous metal, e.g. steel, or may include other types of metal such as aluminum, copper, or other metals used in foundry industries. The treatment of the molten metal may include using the core material 12 for refining the molten metal, e.g. by desulfurization, de-oxidation, alloy addition, inclusion removal, inclusion chemistry modification, and homogenization.

It will be appreciated that various of the above-disclosed and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claim or claims.

The invention claimed is:

1. An elongated cored wire for treating molten metal, comprising:

a solid elongated rod including at least one of sulfur, magnesium, tin, antimony, lead, sodium, calcium metal, aluminum metal, nickel metal, an alloy of calcium-silicon, an alloy of ferro-titanium, an alloy of ferro-boron, an alloy of calcium-aluminum, an alloy of magnesium-calcium, an alloy of magnesium-aluminum, or combinations thereof, a length of the rod extending along a length of the cored wire;

a particulate material fully radially surrounding the rod along the length of the cored wire; and an exterior metal jacket radially surrounding the rod and the particulate material along the length of the cored wire;

wherein when the cored wire is introduced into the molten metal, the particulate material undergoes thermal decomposition to release carbon dioxide, hydrocarbons, or combinations thereof; and wherein the particulate material consists of wood, bauxite, cellulose, bentonite clays, lime, calcium oxide, hemp, cotton, burlap, jute, flax, rayon, felt, silk, or combinations thereof.

2. The cored wire of claim 1, wherein:

the rod is a single piece of material; and the particulate material fully radially surrounds only the rod.

3. The cored wire of claim 2, wherein the rod comprises magnesium.

4. The cored wire of claim 1, wherein the particulate material includes the wood.

5. The cored wire of claim 4, wherein the wood has a moisture content less than 10 wt %.

6. The cored wire of claim 1, wherein the jacket is closed by a seam extending along the length of the cored wired.

7. A method of making a cored wire for treating molten metal:

providing a metal strip defining a trench extending along a length of the metal strip;

providing a solid rod including at least one of sulfur, magnesium, tin, antimony, lead, sodium, calcium metal, aluminum metal, nickel metal, an alloy of calcium-silicon, an alloy of ferro-titanium, an alloy of ferro-boron, an alloy of calcium-aluminum, an alloy of magnesium-calcium, an alloy of magnesium-aluminum, or combinations thereof;

arranging the rod in the trench such that a length of the rod extends along the length of the metal strip;

introducing a particulate material into the trench such that the particulate material is continuous along the length of the metal strip; and radially surrounding the rod and the particulate material with the metal strip along the length of the metal strip;

wherein when the cored wire is introduced into the molten metal, the particulate material undergoes thermal decomposition to release carbon dioxide, hydrocarbons, or combinations thereof;

wherein the particulate material fully radially surrounds the rod along the length of the cored wire; and wherein the particulate material consists of wood, bauxite, cellulose, bentonite clays, lime, calcium oxide, hemp, cotton, burlap, jute, flax, rayon, felt, silk, or combinations thereof.

8. The method of claim 7, wherein the rod is a single piece of material, and the particulate material fully radially surrounds only the rod.

9. The method of claim 7, wherein the particulate material includes the wood.

10. The method of claim 9, wherein the wood has a moisture content less than 10 wt %.

11. The method of claim 7, wherein the step of providing the metal strip includes contouring the metal strip to thereby define the trench.

12. The method of claim 11, wherein the method further includes connecting two edges of the metal strip to thereby radially surround the rod and the particulate material with the metal strip.

13. The method of claim 12, wherein the contouring step and the connecting step are performed by roll forming.

14. The method of claim 13, wherein the rod is arranged in the trench before the particulate material is introduced into the trench.

15. The method of claim 7, wherein the rod comprises magnesium.

16. The method of claim 7, wherein the rod comprises calcium metal.

17. A method of treating molten metal comprising:

providing a cored wire including:

a solid rod extending along a length of the cored wire and including at least one of sulfur, magnesium, tin, antimony, lead, sodium, calcium metal, aluminum metal, nickel metal, an alloy of calcium-silicon, an alloy of ferro-titanium, an alloy of ferro-boron, an alloy of calcium-aluminum, an alloy of magnesium-calcium, an alloy of magnesium-aluminum, or combinations thereof, a particulate material fully radially surrounding the rod along the length of the cored wire, and an exterior metal jacket radially surrounding the rod and the particulate material along the length of the cored wire; and introducing the cored wire into the molten metal, such that the particulate material undergoes thermal decomposition to release carbon dioxide, hydrocarbons, or combinations thereof as a shroud around a leading end of the rod to thereby allow the calcium at the leading end of the rod to melt;

wherein the particulate material consists of wood, bauxite, cellulose, bentonite clays, lime, calcium oxide, hemp, cotton, burlap, jute, flax, rayon, felt, silk, or combinations thereof.

18. The method of claim 17, wherein:

the rod is a single piece of material; and the particulate material fully radially surrounds only the rod.

19. The method of claim 17, wherein the rod includes magnesium.

20. The method of claim 17, wherein:

the particulate material has a moisture content less than 10 wt %.

* * * * *